US007008263B2

(12) United States Patent
Holland

(10) Patent No.: US 7,008,263 B2
(45) Date of Patent: Mar. 7, 2006

(54) COAXIAL CABLE CONNECTOR WITH DEFORMABLE COMPRESSION SLEEVE

(75) Inventor: Michael Holland, Santa Barbara, CA (US)

(73) Assignee: Holland Electronics, Ventura, CA (US)

( * ) Notice: Subject to any disclaimer, the term of this patent is extended or adjusted under 35 U.S.C. 154(b) by 0 days.

(21) Appl. No.: 10/902,974

(22) Filed: Jul. 30, 2004

(65) Prior Publication Data

US 2005/0260890 A1 Nov. 24, 2005

Related U.S. Application Data

(60) Provisional application No. 60/572,173, filed on May 18, 2004.

(51) Int. Cl.
*H01R 9/05* (2006.01)

(52) U.S. Cl. ..... 439/578; 439/584

(58) Field of Classification Search ..... 439/578, 439/584, 585

See application file for complete search history.

(56) References Cited

U.S. PATENT DOCUMENTS 5,007,861 A * 4/1991 Stirling ..... 439/578
5,997,350 A * 12/1999 Burris et al. ..... 439/585
6,089,912 A * 7/2000 Tallis et al. ..... 439/584
6,210,222 B1 * 4/2001 Langham et al. ..... 439/583
6,530,807 B1 * 3/2003 Rodrigues et al. ..... 439/584
6,817,896 B1 * 11/2004 Derenthal ..... 439/584
6,929,289 B1 * 8/2005 Guest ..... 285/322
6,939,169 B1 * 9/2005 Islam et al. ..... 439/578

* cited by examiner

*Primary Examiner*—Briggitte R. Hammond
(74) *Attorney, Agent, or Firm*—Michael G. Petit

(57) ABSTRACT

A male compression-type coaxial cable connector having a compression sleeve slidingly disposed within an axial conduit within a connector body. The prepared end of the coaxial cable is inserted through the compression sleeve and advanced into the connector body. Subsequent advancement of the compression sleeve within the axial conduit, with the assistance of a compression tool, forces the deformable leading end of the compression sleeve radially inward to compress the cable jacket and braid thereby providing secure attachment of the connector to the cable. In a first embodiment, the compression sleeve is removable and can be replaced with another compression sleeve having a different inner diameter to accommodate a variety of coaxial cables. In a second embodiment, the compression sleeve is permanently attached to the connector. Advancement of the compression sleeve forces a separate compression ring disposed within the conduit forwardly, the compression ring deforming inwardly during advancement to affix the cable to the connector. In a third embodiment, the barb, which is disposed on the trailing end of prior art shanks, is disposed forward of the trailing end of the shank.

1 Claim, 13 Drawing Sheets

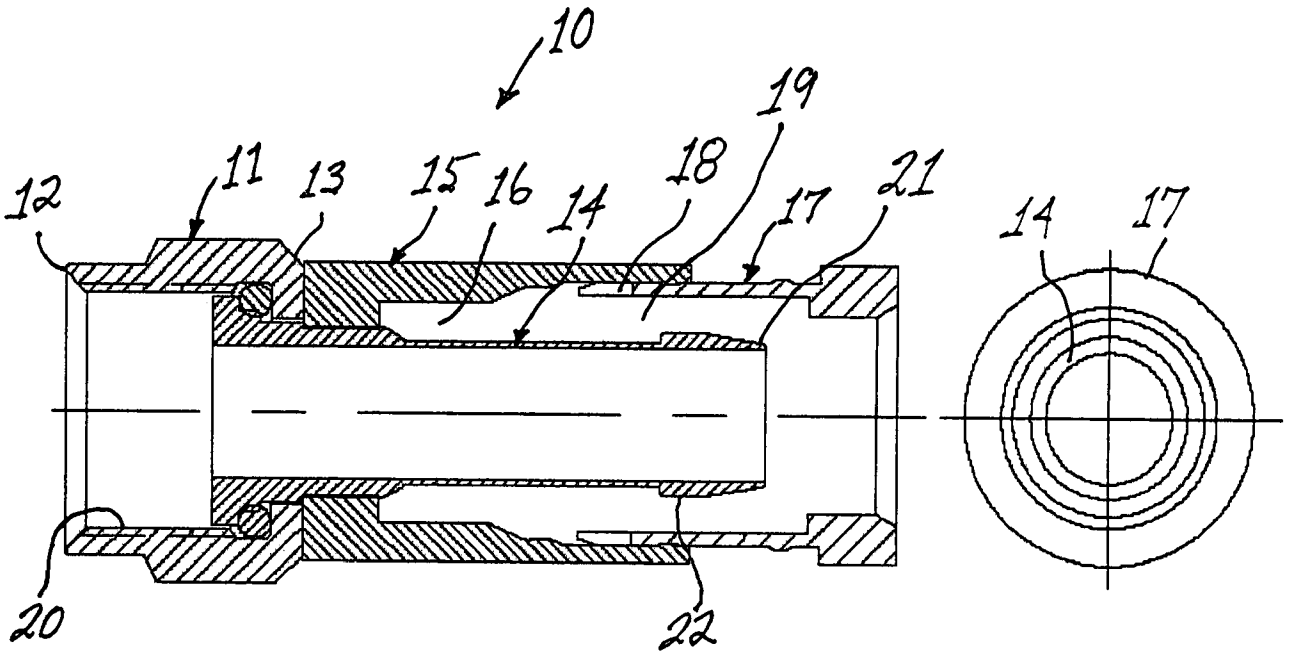
Figure 1
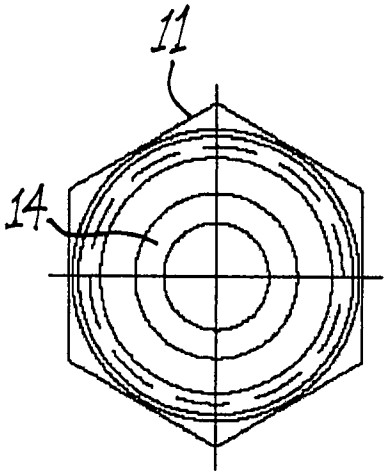
Figure 2
Figure 3

COAXIAL CABLE CONNECTOR WITH DEFORMABLE COMPRESSION SLEEVE

This application claims the benefit of U.S. Provisional Application No. 60/572,173, filed May 18, 2004.

BACKGROUND OF THE INVENTION

1. Field of the Invention

The present invention relates to male coaxial cable connectors operable for electrically connecting a coaxial cable to a mating female port, and, more particularly, in a first embodiment to a male coaxial cable connector having a compression sleeve with a deformable leading end slidably disposed within an axial conduit of a body portion of the connector. In a second embodiment, a separate compression ring is disposed within the axial conduit forward of the compression sleeve.

2. Prior Art

Connectors adapted to form a secure, electrically conductive connection between a coaxial cable and a threaded female port have are well known in the art. Such prior art connectors are discussed, for example, in U.S. Pat. No. 6,217,383 to Holland et al., U.S. Pat. Nos. 6,676,446, 6,153,830 and U.S. Pat. No. 6,558,194 to Montena, U.S. Pat. No. 5,024,605 to Ming-Hua, U.S. Pat. No. 4,280,749 to Hemmer, U.S. Pat. No. 4,593,964 to Formey, Jr. et al., U.S. Pat. No. 5,007,861 to Stirling, U.S. Pat. No. 5,073,129 to Szegda, U.S. Pat. No. 3,710,005 to French and U.S. Pat. No. 5,651,699 to Holliday. U.S. Pat. No. 5,879,191 to Burris, discusses prior art efforts to provide a coaxial connector which is moisture-proof and minimizes radiative loss of signal from the cable. A radial compression type of coaxial cable connector of the type generally used today, is described in detail in U.S. Pat. No. 5,632,651 to Szegda, and the disclosure and discussion of the prior art of Szegda '651 relating to radial compression coaxial cable connectors is incorporated herein by reference thereto.

While the innovative plethora of prior art connectors, some of which are disclosed above, provide improved moisture sealing and/or RF leakage characteristics, all have inherent limitations. For example, the integrity of the attachment between the cable and connector is "craft sensitive", depending on the skill of the installer. In order to provide a secure, sealing engagement between a compression-type male coaxial cable connector and a coaxial cable, a series of steps must be performed. Installation of a coaxial cable connector on a coaxial cable requires that the end of the cable first be prepared to receive the connector. The connector is then manually forced onto the prepared end of the cable until the protective jacket and underlying conductive braid of the cable are separated from the dielectric core of the cable by engagement with a tubular shank disposed therebetween. The cable is further advanced into the connector by hand, which requires the application of substantial force by the installer, until the correct depth of insertion is attained. Finally, the connector is securely affixed to the cable by compressing the connector, again by hand, with a compression tool.

With most prior art connectors, during the compression step, the cable jacket and conductive braid are compressed against an annular barb disposed on the outer surface of the aforesaid underlying tubular shank during the final several millimeters of compressive travel. If the installer fails to completely compress the connector, especially in the final 20 percent of the compressive range, the connector may come loose. In addition, if the cable is not fully inserted into the conduit, the connector may come loose and/or the electrical connection may fail. In the above-referenced prior art patents, the compression sleeve is nondetachably attached to the trailing end of the connector body thereby recessing the trailing end of the ferrule or center post within the connector where it is not visible to an installer.

The step of inserting the prepared end of a cable into a connector such that the center post or ferrule on the connector slides between and separates the braided shielding from the dielectric layer of the cable is an art. If the trailing end of the ferrule is recessed too deeply within the trailing end of a connector, it may be difficult to achieve proper alignment in order to accomplish the intended function. Accordingly, there is an advantage to providing a connector wherein the compression sleeve may be detached from the trailing end of the connector body to facilitate visualization of the trailing end of the ferrule and enable proper insertion of the cable into the connector. Rodrigues et al., in U.S. Pat. No. 6,530,807, provides a connector that includes a connector body having a cable receiving end and an opposed connection end. A locking sleeve is provided in detachable, re-attachable snap engagement with the insertion end (i.e., trailing end) of the connector body for securing the cable in the connector body. The cable may be terminated to the connector by inserting the cable into the locking sleeve or the locking sleeve may be detachably removed from the connector body and the cable inserted directly into the connector body with the locking sleeve detached subsequently.

The skilled artisan will appreciate that it would be an advancement in the art to provide a male coaxial cable connector, particularly a connector operable for attachment to, but not limited to, F-type, BNC and RCA-type female fittings, wherein a single such male coaxial cable connector can be securely attached to coaxial cables in a conventional manner (i.e., compression) even when different cables having different outer diameters are employed.

SUMMARY

The present invention provides a compression-type coaxial cable connector of integral construction except that in a first embodiment the compression sleeve, employed for nonreleasably affixing the connector to the cable, is removable or "detachable/reattachable". In another "large bore" embodiment, the compression sleeve is permanently affixed to the connector. The connector generally includes a connector nut having a leading end adapted for releasable connection to a mating female port, a trailing end, a tubular shank having a first axial conduit therewithin, a tubular (or slotted) body portion having a second axial conduit and a tubular compression sleeve slidably and removably (i.e., detachably/reattachably) disposed within the second axial conduit, and having a deformable leading end (which may be slotted). The diameter of the second axial conduit within the tubular (or slotted) body portion is stepped or ramped, having a smaller diameter in the leading end than in the trailing end. The trailing end of the wall of the second axial conduit preferably has a plurality of annular gripping ridges and/or grooves thereon that matingly engage gripping grooves and/or ridges on the substantially cylindrical outer surface of the removable compression sleeve.

In a first embodiment, the removable compression sleeve is a substantially cylindrical tubular member having a deformable leading end, a trailing end and a third axial conduit coextensive with the length thereof, the third axial conduit being dimensioned to enable the snug passage of a coaxial cable therethrough. The deformable leading end of the removable compression sleeve, which may be either tubular or slotted, is deformable inwardly. The outer surface of the compression sleeve has first detent means preferably comprising a first annular groove thereon adjacent the leading end thereof. The tubular body portion preferably includes a first annular ridge projecting radially inwardly from the wall of the second axial conduit. When the leading end of the compression sleeve is advanced forwardly through the trailing end of the second axial conduit in the tubular body portion, the first annular ridge within the second axial conduit of the tubular body portion releasably engages the first annular groove on the compression sleeve to form a compressible coaxial cable connector assembly having "semi integral" construction in the sense that although the compression sleeve is removable, it is loosely held within the second axial conduit by detent means unless intentionally removed such as in the event it is necessary to replace the compression sleeve with a compression sleeve having an axial conduit with a different inner diameter. The term "detachable", as used herein to describe a compression sleeve, means that the compression sleeve may be facilely detached and removed from the connector and reattached thereto without damaging either the compression sleeve or the connector body.

The tubular body portion of the connector has a barbed ferrule (referred to herein alternatively as a "center post" or "tubular shank") disposed axially therewithin. In accordance with the prior art, the barb is disposed adjacent the trailing end of the ferrule. The tubular shank has an open trailing end. When the prepared end of a coaxial cable is inserted into the trailing end of the compression sleeve conduit, and advanced forwardly through the axial conduit in the tubular body portion of the connector, the trailing end of the ferrule or tubular shank forces the cable jacket and braid over the relatively low profile barb into an annular space between the ferrule and the compression sleeve to overlie the tubular shank forward of the barb as well as over the barb. The cable is further advanced into the connector until the leading end of the braided shielding can be advanced no further.

When it is determined that the prepared end of the coaxial cable is fully advanced into the axial conduit within the body portion, subsequent advancement of the compression sleeve over the body portion deforms the leading end of the compression sleeve radially inwardly which compresses the cable jacket in two places: (a) between the compression sleeve and the barb on the tubular shank; and (b) between the tubular shank and the deformed leading end of the compression sleeve. Further advancement of the compression sleeve is terminated when a second detent means preferably comprising an annular ridge within the conduit of the tubular body portion "snaps" into, and nonreleasably engages, a second annular groove in the outer surface of the compression sleeve. The cable jacket and braid are radially compressed along those portions where they overlie the barb and where they underlie the deformed leading end of the compression sleeve, as well as over the barb, thereby providing a stable two-point connection.

In a second embodiment of the invention the compression sleeve is similar to the compression sleeve described in the first embodiment but is shorter and lacks a deformable end. In the second embodiment, a preferably removable and interchangeable compression ring is disposed within the axial conduit of the connector body portion forward of the leading end of the compression sleeve. When the compression sleeve is advanced within the axial conduit, the forward (leading) end of the compression sleeve urges the trailing end of the compression ring forward. As the trailing end of the compression ring is urged forward, a portion of the compression ring deforms inwardly to compress the braid and underlying jacket of the prepared end of the cable against the tubular shank and, when fully advanced, locks in place to prevent retraction and/or removal.

In practice, when inserting the prepared end of a coaxial cable into a coaxial cable connector, the cable must be inserted such that the barbed trailing end of the ferrule in the connector separates the layer of braided shielding and overlying jacket of the cable from the underlying dielectric layer and interposes itself therebetween. In one embodiment of the present invention, the barb is disposed forward of the trailing end of the ferrule. This modification enables the installer to more easily align and insert the prepared end of a coaxial cable into the connector's axial conduit such that the ferrule is disposed between the braid and the underlying dielectric layer of the cable prior to advancement over the larger diameter barb.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

BRIEF DESCRIPTION OF THE DRAWINGS

FIG. 1 is a longitudinal cross-sectional view of a coaxial cable connector in accordance with a first embodiment of the present invention prior to the insertion of a coaxial cable thereinto and subsequent compression.

FIG. 2 is a left end view of the connector illustrated in FIG. 1.

FIG. 3 is a right end view of the connector illustrated in FIG. 1.

DESCRIPTION OF THE PREFERRED EMBODIMENTS

Figure 7:
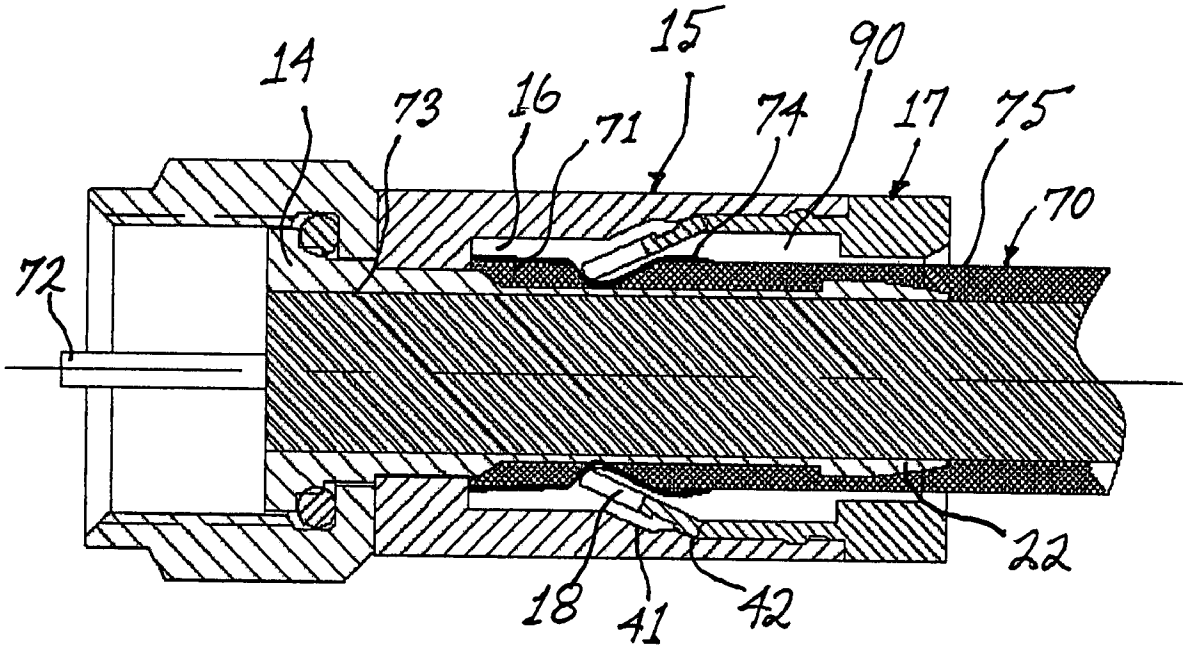
FIG. 7 is a longitudinal cross-sectional view of a coaxial cable connector in accordance with FIGS. 1–6 attached to a coaxial cable, wherein the prepared end of a coaxial cable has been inserted into the axial conduit and the compression sleeve has been advanced into the axial conduit of the body portion to deform the leading end of the compression sleeve radially inward to compress the cable jacket.

Prior to attaching a coaxial cable to a male connector, the end of the cable that will be receiving the connector must first be prepared. It will be understood by the artisan that the preparation of the end of the cable will be in accordance with the type of male coaxial cable connector that the cable 70 (FIG. 7) will be attached (i.e., F-type, BNC, RCA, etc.). In order to prepare the end of a coaxial cable to receive a male connector, a cutting tool is used by an installer to expose a portion of the central conductor 72, a length of the dielectric core 73 and a conductive (grounding) braid 74, as shown in FIG. 7. Again, the respective lengths of each of the elements comprising the coaxial cable 70 that are exposed by the cutting tool will depend on the particular type of male connector to be attached thereto and are in accordance with industry standards. Following exposure of the conductive braid 74, the exposed portion of conductive braid is flared and folded back to overlie the protective jacket 75 as shown in FIG. 7. The thickness of the conductive braid may vary, depending on the manufacturer, and require the application of different amounts of force by the installer in order to correctly position the cable end within the connector prior to attachment. It is an important advancement in the art that the axial conduit in both the tubular body portion and compression sleeve of the present connector may be substantially larger than the outer diameter of the cable while maintaining secure attachment of the connector to the cable as will be discussed below.

FIG. 1 is a longitudinal cross-sectional view of a coaxial cable connector 10 in accordance with the present invention prior to the insertion of a coaxial cable thereinto and subsequent compression. FIG. 2 is a left end view of the connector illustrated in FIG. 1, and FIG. 3 is a right end view of the connector. The connector 10 includes a connector nut 11 having a leading end 12 and a trailing end 13, a tubular shank 14, a tubular (or slotted) body portion 15 having an axial conduit 16 and a tubular compression sleeve 17 having a deformable leading end 18 (which may be slotted) housed within a trailing end 19 of the axial conduit 16 in the tubular body portion 15. The connector nut 11, which is rotatably attached to the leading end of the tubular body portion 15, includes engaging means 20 operable for releasably engaging a female F-type, BNC, RCA connector or other female coaxial cable connector as appropriate. The tubular shank 14, which is well known in the art and common to most, if not all, coaxial cable connectors, is an elongate, generally cylindrical tube having a leading end rotatably attached to the connector nut 11, and a trailing end 21 in opposition thereto. The tubular shank projecting rearwardly from the connector nut 11 preferably includes an annular barb 22 disposed circumferentially thereon. The tubular body portion 15 and tubular shank 14 act cooperatively with the compression sleeve 17 to provide at least one, or, more preferably, two points of radial compression of the outer jacket and conductive braid of the cable.

Figure 6:
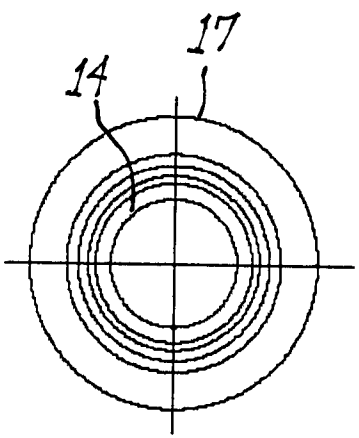
FIG. 6 is a right end view of the connector illustrated in FIG. 4.
Figure 4:
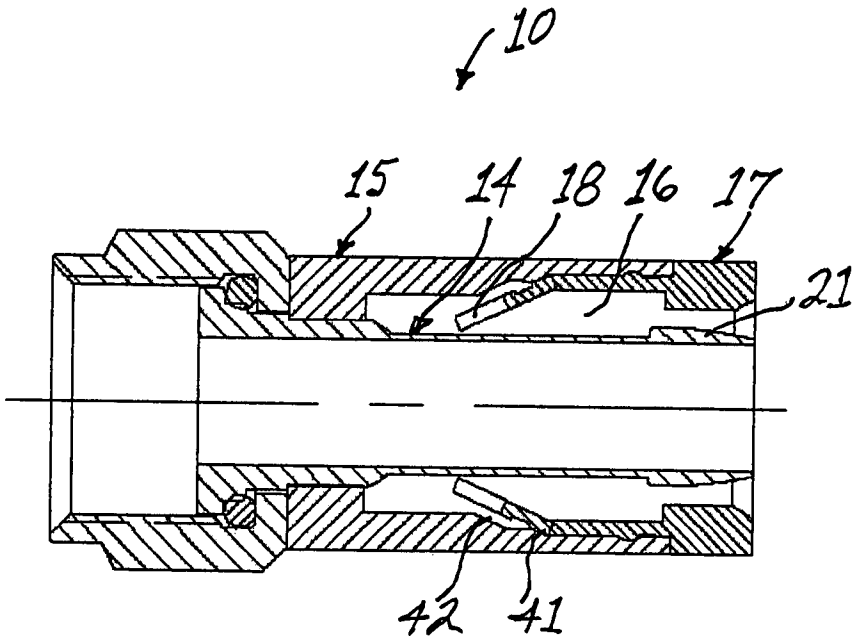
FIG. 4 is a longitudinal cross-sectional view of the coaxial cable connector shown in FIG. 1 after advancement of the compression sleeve into the axial conduit of the body portion.
Figure 5:
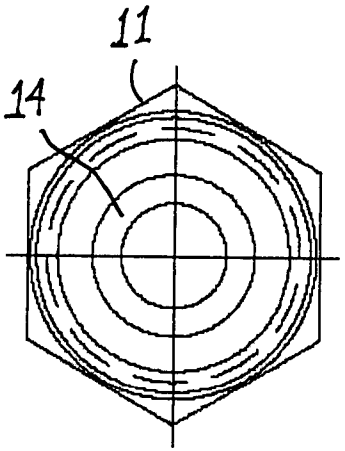
FIG. 5 is a left end view of the connector illustrated in FIG. 4.

With reference to FIG. 4, which is a longitudinal cross-sectional view of a coaxial cable connector 10 wherein the connector 10 is illustrated after advancement of the compression sleeve into the axial conduit of the body portion, a first point of compression of the cable jacket and braid is disposed between the deformable leading end 18 of the compression sleeve 17 and the tubular shank 14, and a second point disposed between the compression sleeve 17 and the barb 21 on the tubular shank as will be discussed below. The diameter of the axial conduit 16 within the tubular (or slotted) body portion 15 is stepped or ramped, as shown at 41 and 42, having a smaller diameter in the leading end than in the trailing end. The trailing end of the wall of the axial conduit 16 preferably has a plurality of annular gripping ridges and/or grooves thereon that matingly engage gripping grooves and/or ridges on a substantially cylindrical outer surface of the compression sleeve. A trailing portion of the tubular shank preferably extends rearwardly beyond the trailing end of the tubular body portion, the trailing portion including the relatively low-profile annular barb disposed near or at the trailing end of the tubular shank.

The compression sleeve 17 is a substantially cylindrical member having a deformable leading end 18, a trailing end and a second axial conduit 90 (FIG. 9) coextensive with the length thereof, the second axial conduit 90 being dimensioned to enable the passage of a prepared end of a coaxial cable therethrough. The deformable leading end of the compression sleeve, which may be either tubular or slotted, is deformable inwardly. The outer surface of the compression sleeve has a first annular groove thereon adjacent the leading end thereof. The tubular body portion includes a first annular ridge projecting radially inwardly from the wall of the axial conduit. When the leading end of the compression sleeve is advanced forwardly through the trailing end of the axial conduit in the tubular body portion, the first annular ridge within the conduit of the tubular body portion releasably engages the first annular groove on the compression sleeve to form a compressible coaxial cable connector assembly having integral construction.

Figure 8:
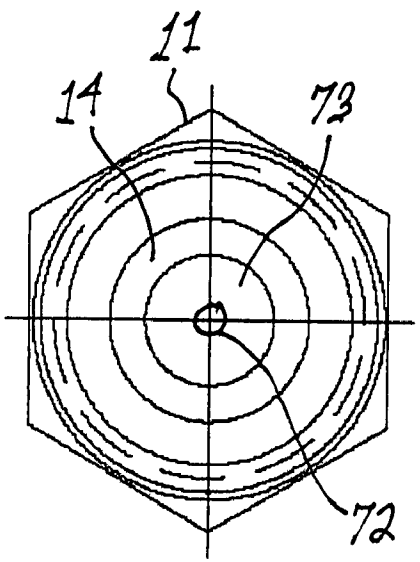
FIG. 8 is a left end view of the connector illustrated in FIG. 7.

FIG. 7 is a longitudinal cross-sectional view of a coaxial cable connector in accordance with FIGS. 1–6 attached to a coaxial cable, wherein the prepared end of a coaxial cable has been threaded through the second axial conduit and advanced into the axial conduit. FIG. 8 is a left end view of the connector illustrated in FIG. 7. In FIG. 7, the compression sleeve 17 is shown fully advanced into the axial conduit 16 of the body portion 15 to deform the leading end 18 of the compression sleeve radially inward to compress the cable jacket 71 and braided shielding 74. When the prepared end of a coaxial cable 70 is inserted into the trailing end of the compression sleeve's second axial conduit 90, and advanced forwardly through the axial conduit 16 in the tubular body portion 15, the trailing end of the tubular shank 14 forces the cable jacket and braid over the relatively low profile barb into an annular space between the shank and the compression sleeve to overlie the tubular shank forward of the barb as well as over the barb. The cable is further advanced into the connector until the leading end of the braided shielding can be advanced no further. When it is determined that the prepared end of the coaxial cable is fully advanced into the axial conduit within the body portion, the compression sleeve 17 is advanced within the axial conduit 16 in the body portion 15. As the leading deformable end 18 encounters a first step or ramp 42, further advancement deforms the leading end 18 of the compression sleeve radially inwardly. A second step or ramp 41 further forces the leading end 18 to deform radially inward. The tip of the leading end 18 of the compression sleeve compresses the cable jacket between the tubular shank and the deformed leading end of the compression sleeve as well as between the compression sleeve and the barb on the tubular shank. Further advancement of the compression sleeve is terminated when a second annular groove within the conduit of the tubular body portion "snaps" into, and engages, a second annular ridge 92 in the outer surface of the compression sleeve. The cable jacket 71 and braid 74 are radially compressed where they overlie the barb and where they underlie the deformed leading end of the compression sleeve, thereby providing a stable two-point connection.

Figure 11:
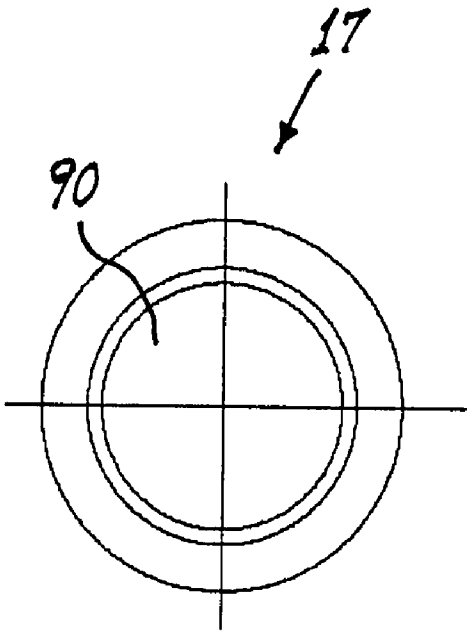
FIG. 11 is a right end view of the compression sleeve illustrated in FIG. 9 prior to compression.
Figure 9:
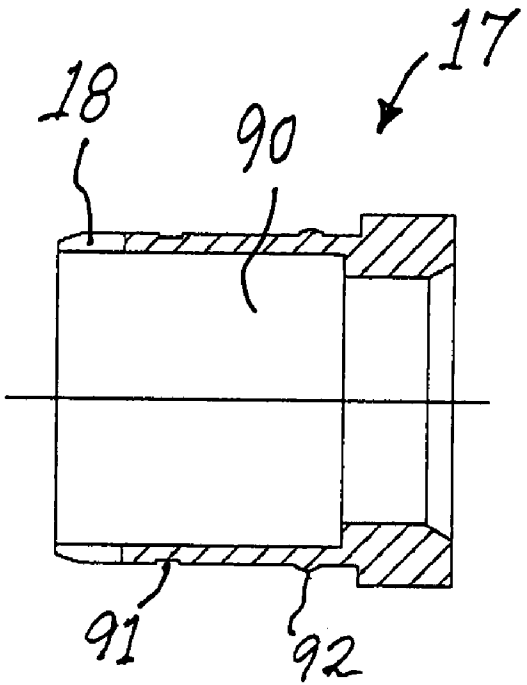
FIG. 9 is a longitudinal cross-sectional view illustrating the compression sleeve of the coaxial coaxial connector of FIGS. 1, 4 and 7.
Figure 10:
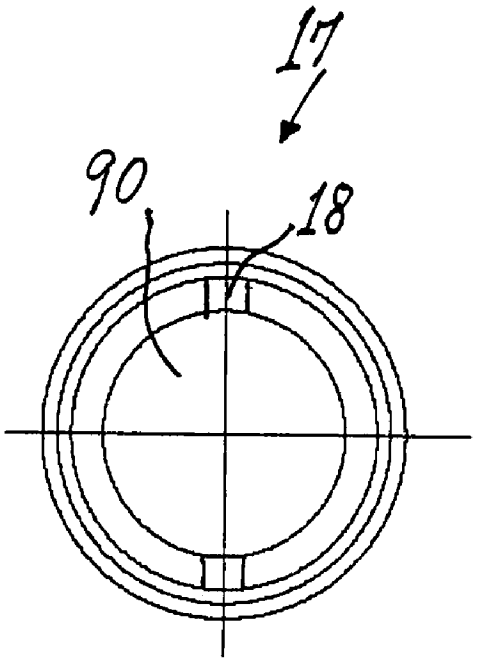
FIG. 10 is a left end view of the compression sleeve illustrated in FIG. 9 prior to compression.

FIG. 9 is a longitudinal cross-sectional view illustrating the compression sleeve of the coaxial coaxial connector of FIGS. 1, 4 and 7 prior to deformation of the deformable leading end 18. FIG. 10 is a left end view of the compression sleeve illustrated in FIG. 9 and FIG. 11 is a right end view of the compression sleeve illustrated in FIG. 9 prior to compression. The annular groove 91 in the outer surface of the connector sleeve matingly and releasably engages an annular ridge on the wall of the axial conduit of the tubular body portion. The annular ridge 92 matingly and nonreleasably engages an annular groove on the wall of the axial conduit to prevent retraction of the compression sleeve after the compression step is completed.

Figure 14:
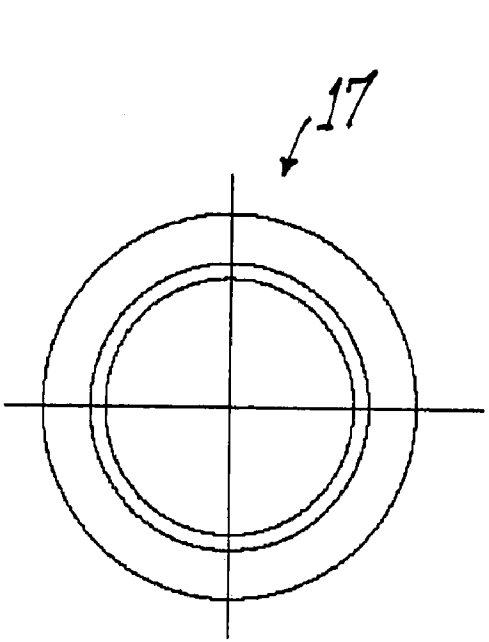
FIG. 14 is a right end view of the compression sleeve illustrated in FIG. 9 after compression and deformation of the deformable leading end of the compression sleeve.
Figure 12:
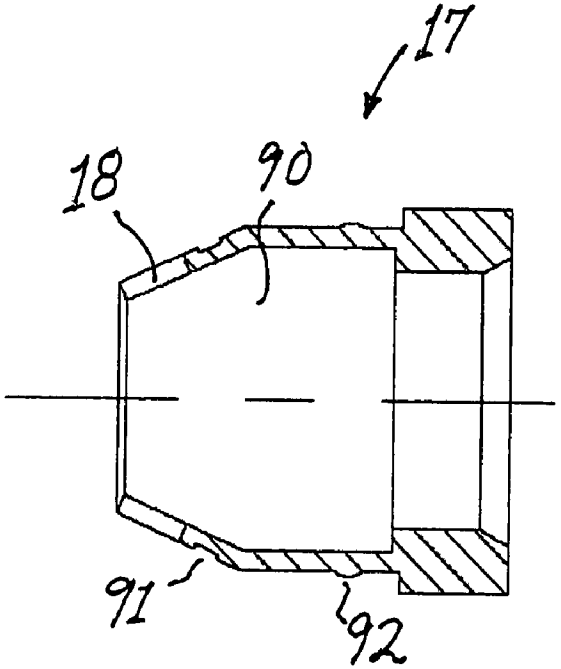
FIG. 12 is a longitudinal cross-sectional view illustrating the compression sleeve of the coaxial coaxial connector of FIGS. 1, 4 and 7 following compression (i.e., advancement into the axial conduit of the body portion (not shown)).
Figure 13:
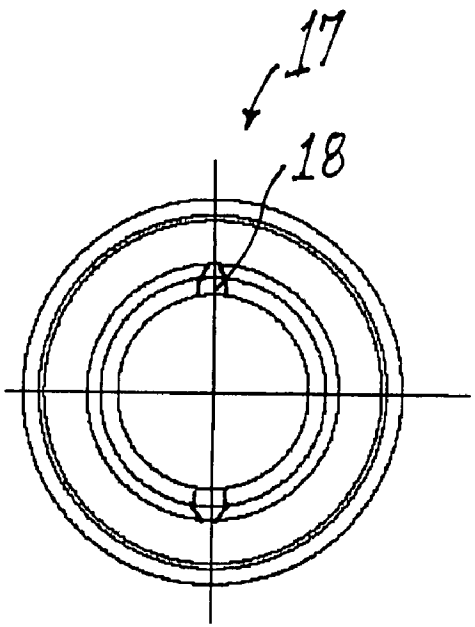
FIG. 13 is a left end view of the compression sleeve illustrated in FIG. 9 after compression and deformation of the deformable leading end of the compression sleeve.
Figure 15:
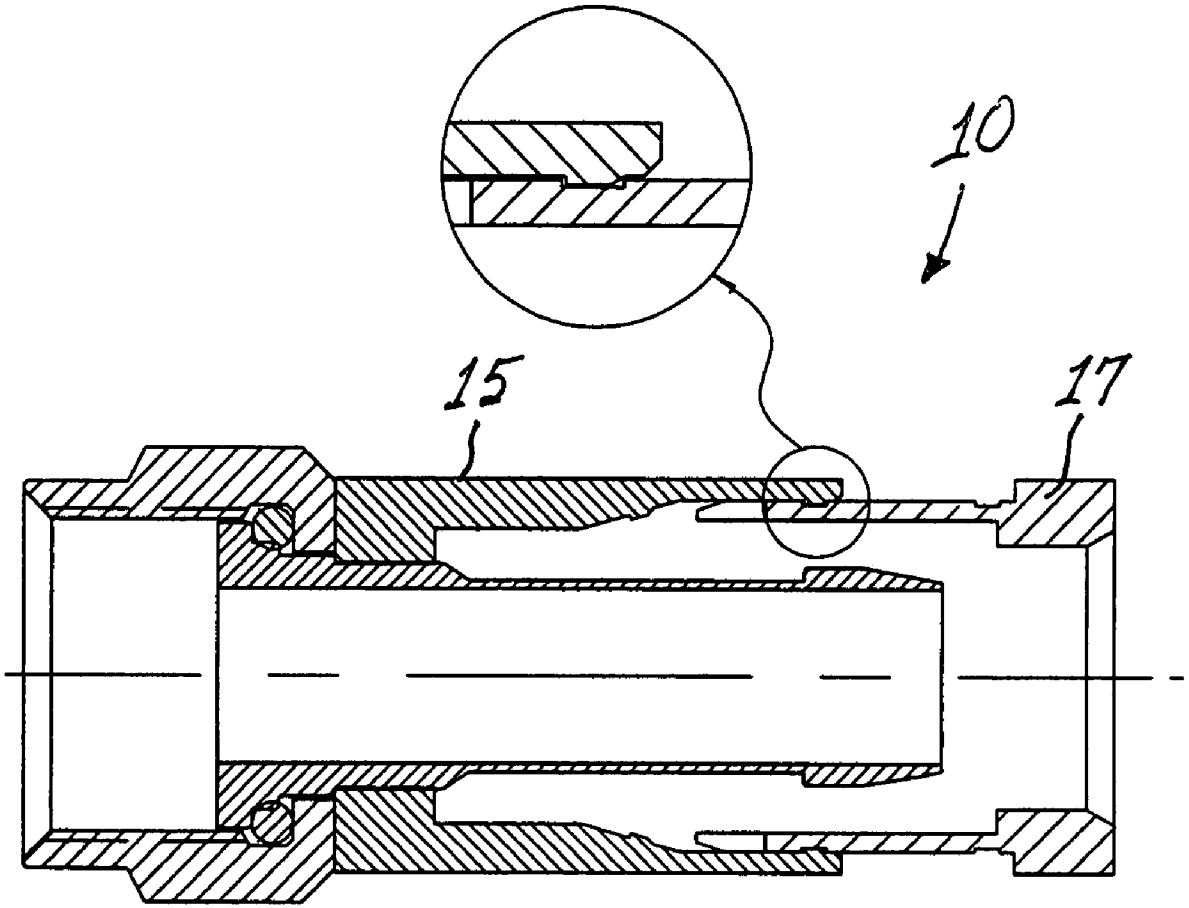
FIG. 15 is a longitudinal cross-sectional view of a coaxial cable connector in accordance with FIG. 1 of the present invention prior to the insertion of a coaxial cable thereinto and subsequent compression, the figure providing detail of the connection between the compression sleeve and the body portion.
Figure 16:
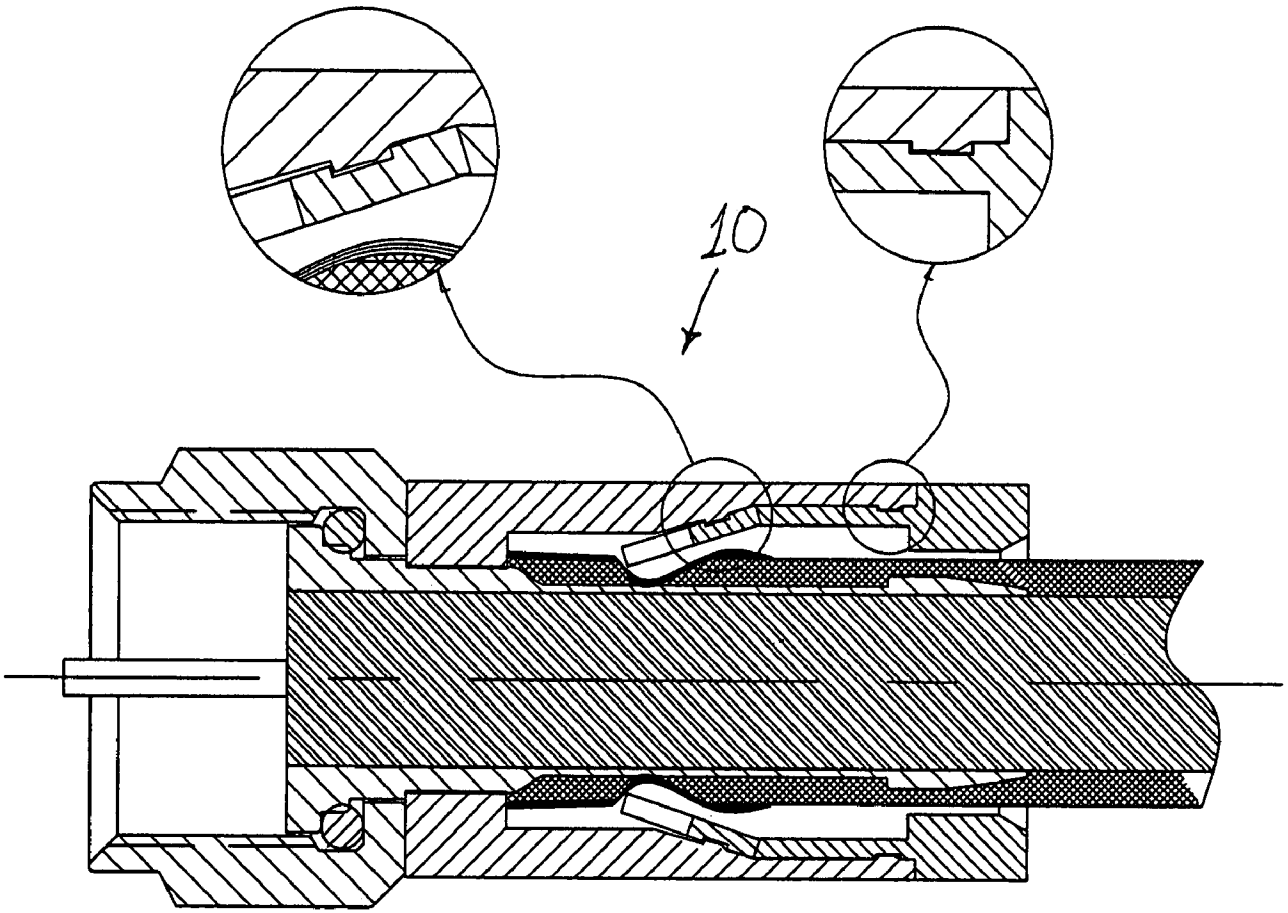
FIG. 16 is a longitudinal cross-sectional view of a coaxial cable connector in accordance with the present invention, shown in FIG. 1, wherein the connector is illustrated after advancement of the compression sleeve into the axial conduit of the body portion, the Figure illustrating details of the locking engagement between the connector body and compression sleeve.

FIG. 12 is a longitudinal cross-sectional view illustrating the compression sleeve of the coaxial coaxial connector of FIGS. 1, 4 and 7 following compression (i.e., after advancement of the leading end of the compression sleeve into the axial conduit of the body portion (not shown in FIG. 12)). FIG. 13 is a left end view of the compression sleeve illustrated in FIG. 9 after compression and deformation of the deformable leading end of the compression sleeve, and FIG. 14 is a right end view of the compression sleeve illustrated in FIG. 9 after compression and deformation of the deformable leading end of the compression sleeve. FIGS. 15 and 16 provide a detailed view of the locking mechanism before (FIG. 15) and after (FIG. 16) compression of the connector 10.

With the increased use of internet and pay-per-view digital services on cable TV systems, it is desirable to have a higher level of shielding on coaxial cables in order to prevent ingress of RF noise. In large cities, where RF noise is a problem, cable companies have begun using a coaxial cable having the same diameter dielectric layer (RG-6 for example) but with the thickness of the overlying shield increased from a double shielding to triple or quad shielding. These additional shielding braids make the outer diameter of the cable larger, thereby requiring a cable installer to have access to a variety of connectors in order to ensure that a connector is available that can be securely attached to each cable.

It is advantageous to have one connector that can be used for all sized braid thickness within a family of RG-6 or RG-59 cables which are the typical CATV cables. Therefore, it is desirable to provide a male coaxial cable connector that will work well with a variety of cable braid sizes within a type of cable. Though manufacturers have approached this problem in different ways, the present invention provides a modification of the coaxial cable connector disclosed in U.S. Pat. No. 6,217,383 that enables the modified connector to be attached to a variety of cable thicknesses.

Figure 17:
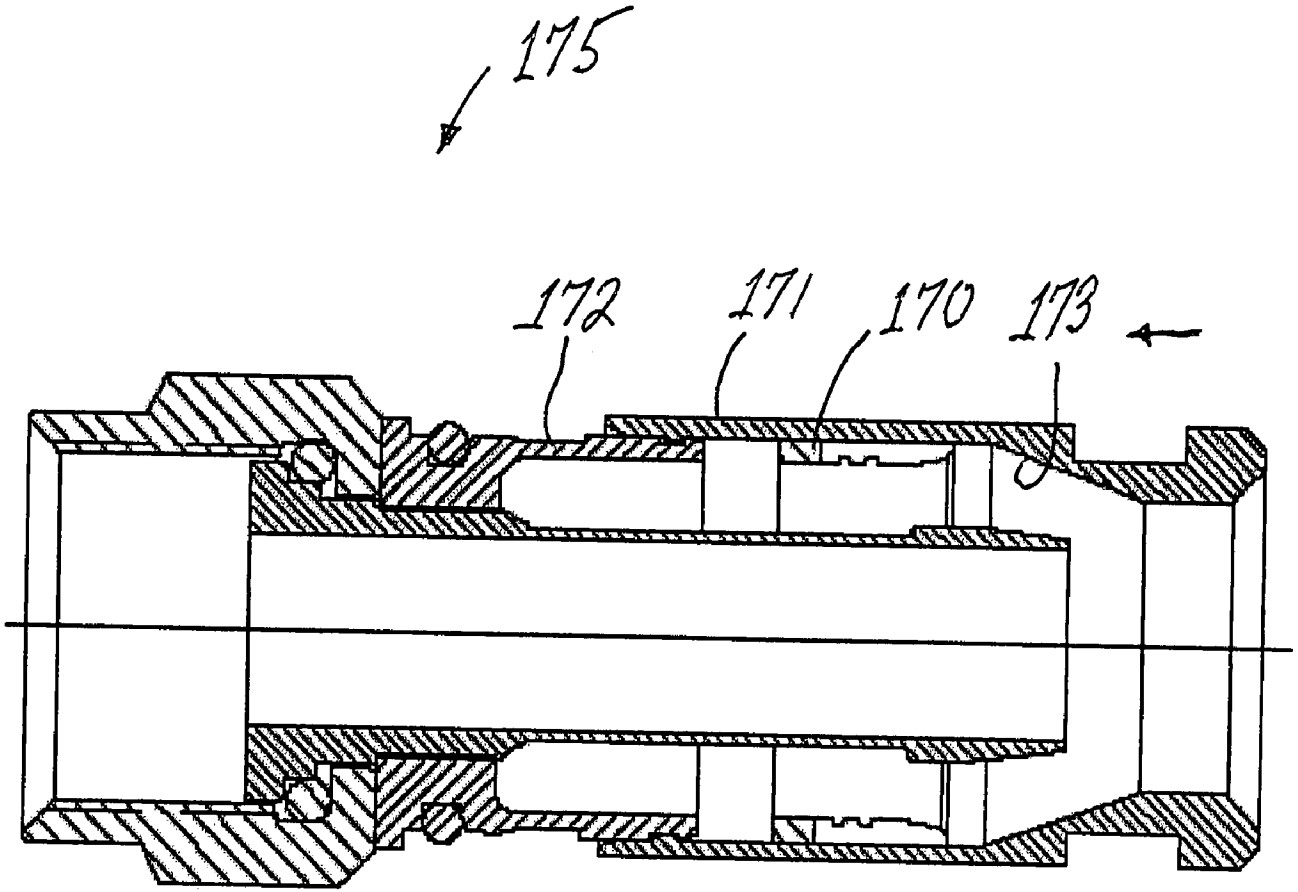
FIG. 17 is a longitudinal cross-sectional view of a coaxial cable connector in accordance with a second embodiment of the present invention prior to the insertion of a coaxial cable thereinto and subsequent compression, the Figure illustrating the removable disposition of a detachable clamping ring within the axial bore of the compression sleeve.
Figure 18:
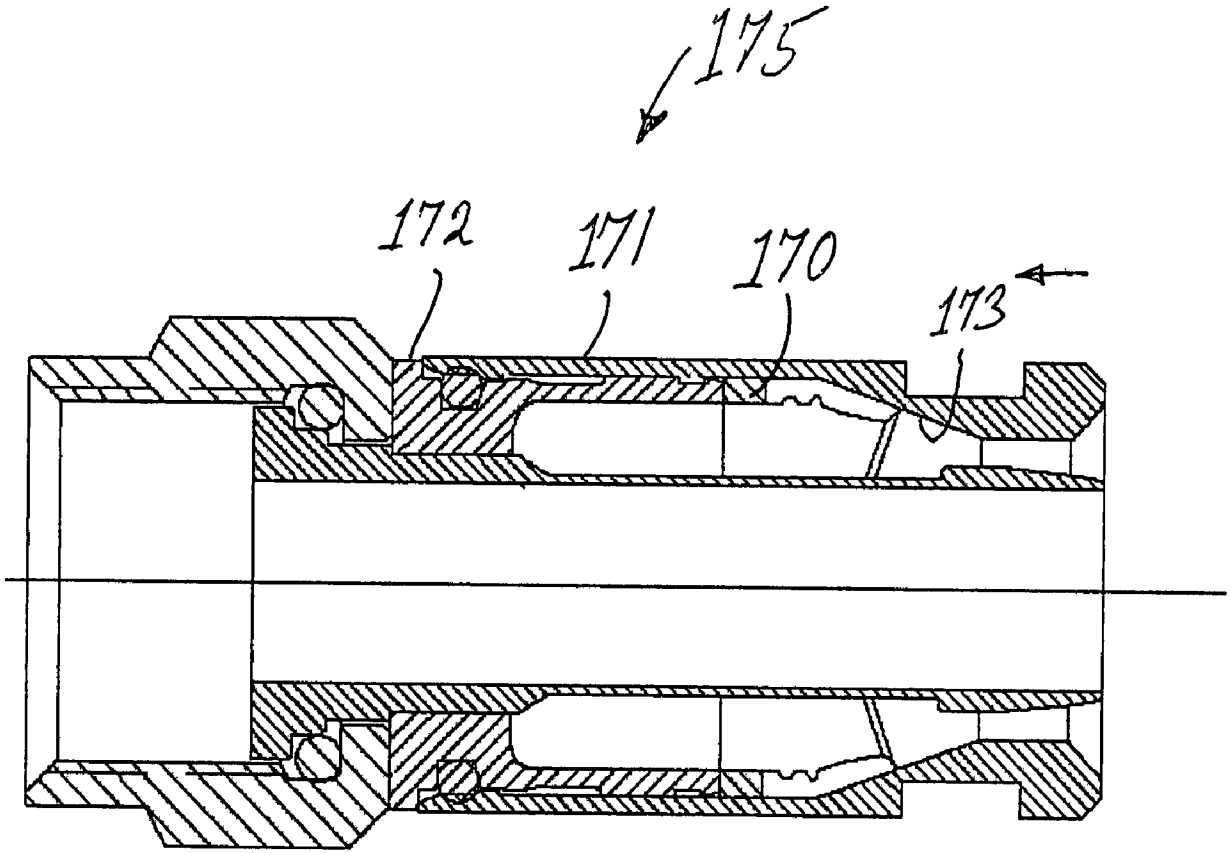
FIG. 18 is a longitudinal cross-sectional view of the coaxial cable connector in accordance with the second embodiment of the present invention shown in FIG. 17 after compression, the Figure illustrating the deformation of the clamping ring within the axial bore of the compression sleeve following compression.
Figure 19:
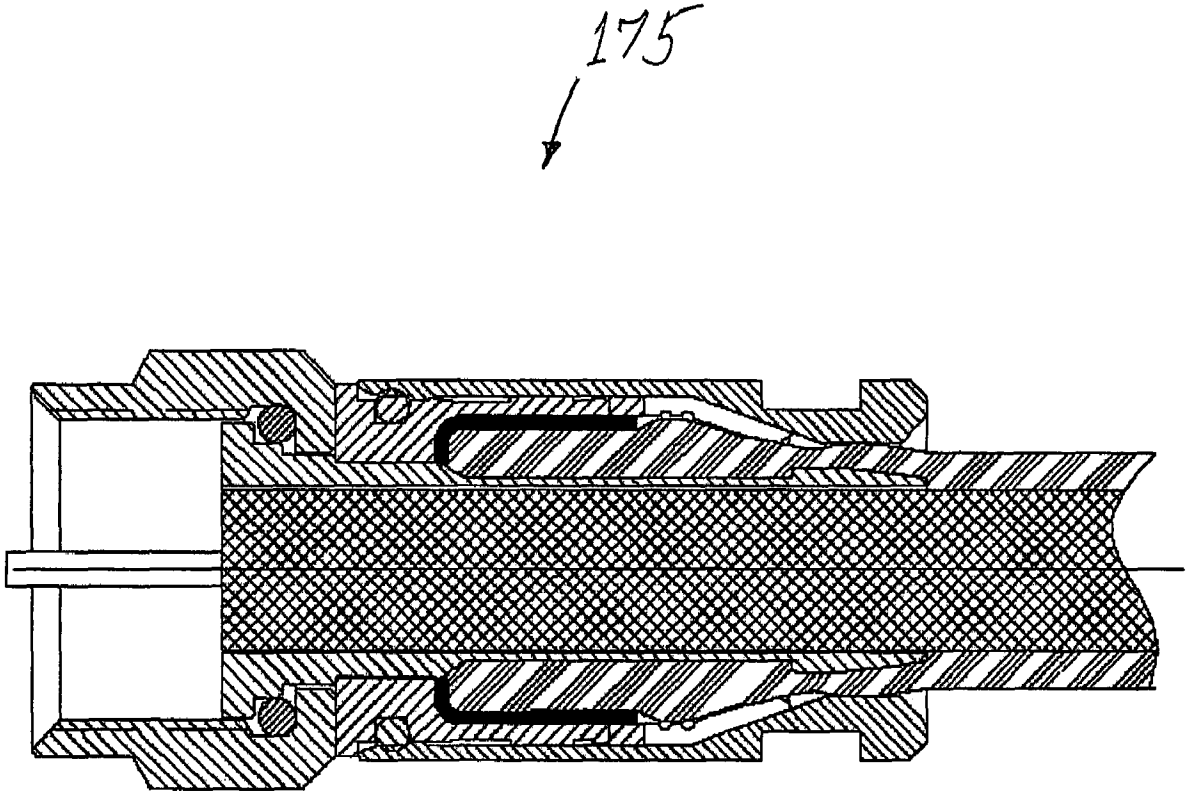
FIG. 19 shows the connector of FIGS. 17 and 18 with a cable connected thereto following compression.
Figure 20:
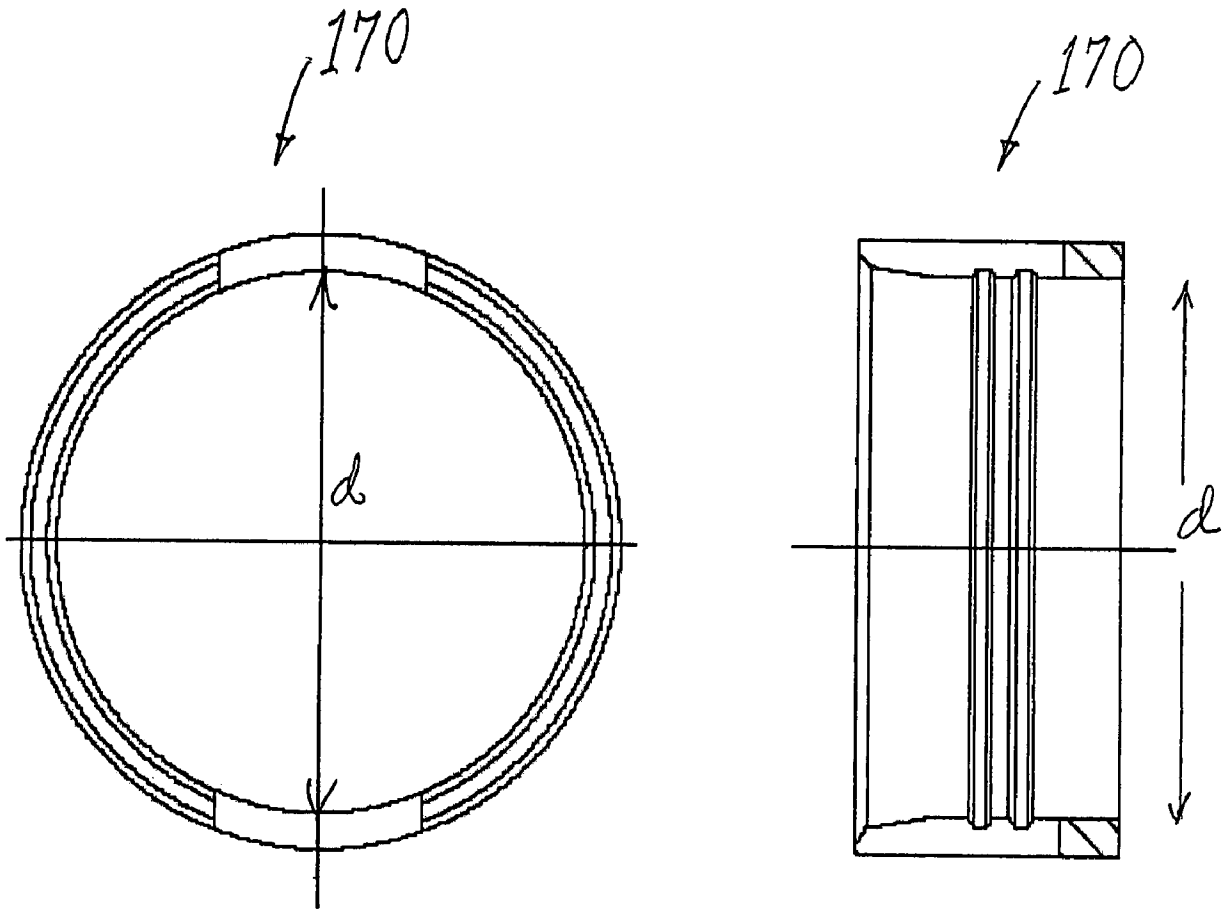
FIG. 20 is a left end view (left) and cross-sectional longitudinal view (right) of a clamping ring in accordance with the second embodiment of the present invention.

In review, the connector disclosed in the aforesaid '383 patent has a fixed compression ring attached to the connector body. The inside diameter of the ring determines the largest size cable that can be used. If the inner diameter is sized for the largest size cable, then the smaller OD cable will not be clamped and held by this section of the connector. To solve this problem, and provide a universal connector, the invention detaches the (formerly fixed) clamping ring (referred to herein in the alternative as "compression ring"), allowing the user to insert a properly sized clamping ring 170 for the braid cable in use. An embodiment of the uncompressed (i.e. unconnected) modified connector is illustrated in cross-sectional view in FIG. 17. The detached clamping ring 170 is removably inserted within the axial bore of the compression sleeve 171 prior to connection of the compression sleeve to the connector body 172. When the compression sleeve 171 is advanced in the direction of the arrow, the detached clamping ring 170 abuts the connector body 172. Due to the beveled or ramped inner diameter 173 of the compression sleeve 171, further advancement forces the trailing end of the detached clamping ring 170 inwardly against the cable (not shown), as illustrated in FIG. 18. FIG. 19 is a cross-sectional view of the connector 175 installed on the prepared end of a coaxial cable. FIG. 20 is two views of a detached clamping ring 170 showing an end view on the left and a cross-sectional longitudinal view on the right. The rings 170 are provided in a variety of inner diameters d which may be inserted into the compression sleeve prior to attachment of the connector 175 to a cable.

It should be clear to the artisan that the outer compression sleeve 171 may be supplied with the correct ring 170 preinstalled therewithin, or the ring 170 can be provided in a variety of diameters d for insertion into the connector sleeve 171 prior to installing the connector 175. The user may either remove the compression sleeve and insert a newly sized ring or purchase the connector with the ring separate for easy field use once the cable size is selected.

Figure 21:
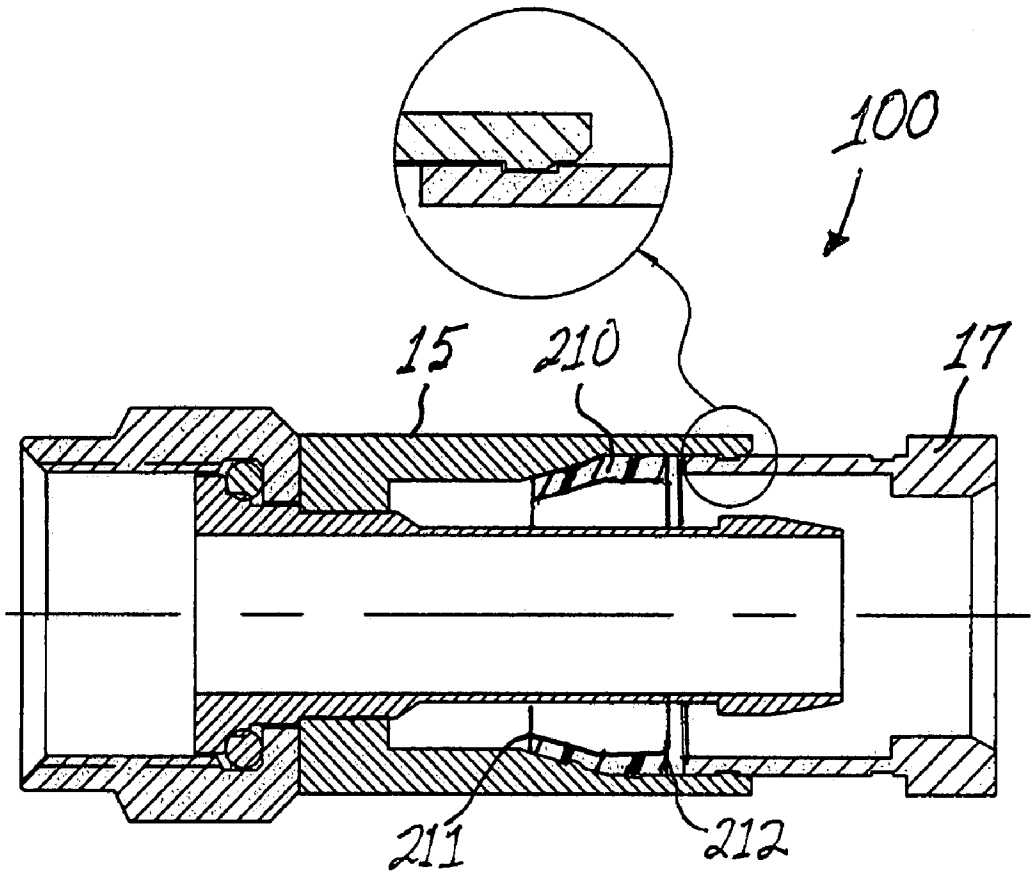
FIG. 21 is a longitudinal cross-sectional view of a coaxial cable connector in accordance with a second embodiment of the present invention prior to the insertion of a coaxial cable thereinto and subsequent compression. In the second embodiment, advancement of the compression sleeve urges a deformable ring forwardly which causes compression of the prepared end of an underlying cable.

A third embodiment of a coaxial cable connector in accordance with the invention is similar in operation to the second embodiment 175. The third embodiment 100 (FIG. 21) employs, in combination, a compression sleeve with a non-deformable forward end and a removable, deformable compression ring disposed forward thereof. The deformable compression ring is separate from the compression sleeve. FIG. 21 is a longitudinal cross-sectional view of a coaxial cable connector 100 in accordance with a third embodiment of the present invention prior to the insertion of a coaxial cable thereinto. In the third embodiment 100, advancement of the compression sleeve 17 urges the deformable compression ring 210 forwardly which causes compression of the prepared end of an underlying cable (not shown). In the third embodiment 100, the compression sleeve 17 may be either permanently or removably attached to the connector body 15. Preferably, the compression sleeve 17 is removably attached to the connector body 15. In a manner analogous to the second embodiment, removable attachment of the compression sleeve enables the installer to remove the compression sleeve in order to exchange the deformable compression ring 210 for another deformable compression ring having a different inner diameter that is optimally matched to the outer diameter of the cable being used. The deformable compression ring 210 preferably includes slot(s) on the leading end thereof to facilitate compression.

Figure 22:
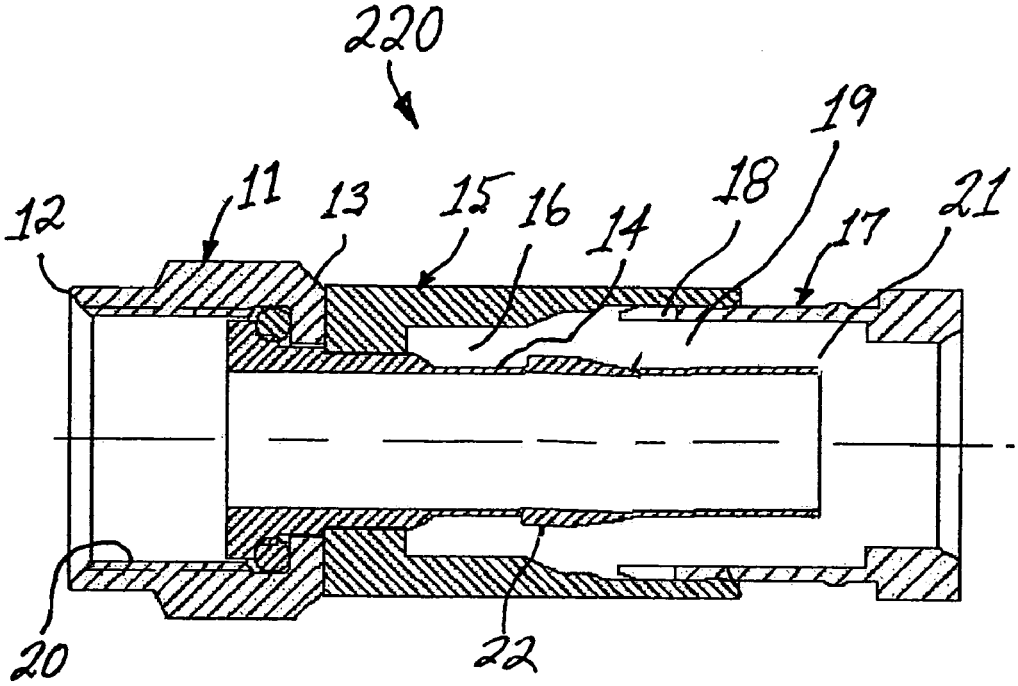
FIG. 22 is a longitudinal cross-sectional view of a third embodiment of a connector in accordance with the first embodiment of the present invention (shown in FIGS. 1 and 4) wherein the barb on the ferrule is disposed forward of the ferrule's trailing end.
Figure 23:
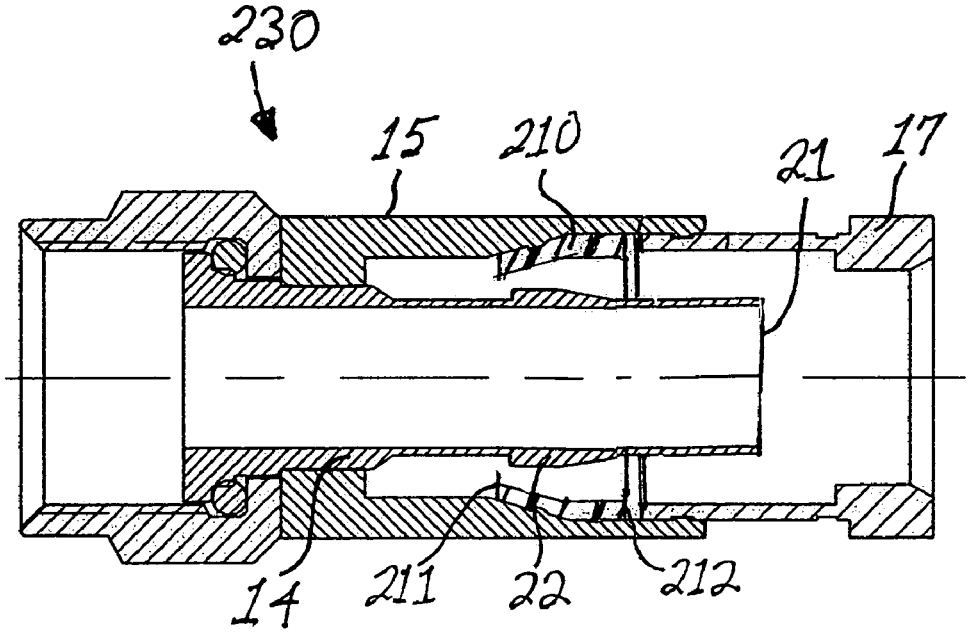
FIG. 23 is a longitudinal cross-sectional view of a third embodiment of a connector in accordance with the second embodiment of the present invention (shown at numeral 100 in FIG. 21) wherein the barb on the ferrule is disposed forward of the ferrule's trailing end.

In practice, when inserting the prepared end of a coaxial cable into a coaxial cable connector, the cable must be inserted such that the barbed trailing end of the ferrule in the connector separates the layer of braided shielding and overlying jacket of the cable from the underlying dielectric layer and interposes itself therebetween. In a third embodiment of the present invention, which may be incorporated into any of the other embodiments of the present invention, the barb is disposed forward of the trailing end of the ferrule as shown in FIGS. 22 and 23. This modification enables the installer to more easily align and insert the prepared end of a coaxial cable into the connector's axial conduit such that the ferrule is disposed between the braid and the underlying dielectric layer of the cable prior to advancement over the larger diameter barb. FIG. 22 is a longitudinal cross-sectional view of an exemplary third embodiment 220 of a connector in accordance with the first embodiment of the present invention (shown at numeral 10 in FIGS. 1 and 4) wherein the barb 22 on the ferrule is disposed forward of the ferrule's trailing end 21. FIG. 23 is a longitudinal cross-sectional view of a third embodiment of a connector in accordance with another exemplar in accordance with the second embodiment of the present invention (shown at numeral 100 in FIG. 21) wherein the barb 22 on the ferrule is disposed forward of the ferrule's 14 trailing end 21. The compression or clamping ring 210 in the embodiments shown in FIGS. 22 and 23 can be made from a deformable plastic or a compressible rubber ring such as the sealing ring taught by Baker in U.S. Pat. No. 4,614,390.

While particular embodiments of the present invention have been illustrated and described, it would be obvious to those skilled in the art that various other changes and modifications can be made without departing from the spirit and scope of the invention. The critical features of the present invention are, in one aspect, the provision of a male coaxial cable connector having a compression sleeve with a deformable leading end slidably disposed within an axial conduit of the tubular body portion. In another aspect of a connector in accordance with the present invention, the barb on the ferrule is disposed forward, not at, the trailing end of the ferrule. Accordingly, the compression sleeve and connector body, in combination, may be used with any coaxial cable connector if used in the manner disclosed by the present invention. Similarly, in the second embodiment, the detached clamping ring 170 may be either permanently attached to the compression sleeve or removable therefrom. It is therefore intended to cover in the appended claims all such changes and modifications that are within the scope of this invention.

What I claim is:

1. A reusable male coaxial cable connector comprising a rotatably-mounted connector nut, a tubular shank having a leading end adjacent said connector nut and a trailing end extending rearwardly from said connector nut, a tubular body portion concentrically mounted to overlie said tubular shank, said tubular body portion having a leading end rotatably connected to said connector nut and a trailing end in opposition thereto, said tubular body portion having a first axial conduit, a compression sleeve having a leading end and a second axial conduit slidably and removably disposed within said first axial conduit and a deformable compression ring removably disposed within said first axial conduit forward of said leading end of said compression sleeve.

* * * * *